US005927592A

United States Patent [19]

Kranz

[11] Patent Number: 5,927,592

[45] Date of Patent: Jul. 27, 1999

[54] LIMITED POCKET ENVELOPE

[75] Inventor: Richard Kranz, Leawood, Kans.

[73] Assignee: Tension Envelope Corp., Kansas City, Mo.

[21] Appl. No.: 08/871,931

[22] Filed: Jun. 10, 1997

[51] Int. Cl.[6] ..... B65D 27/04

[52] U.S. Cl. ..... 229/71

[58] Field of Search ..... 229/71, 72, 315

[56] References Cited

U.S. PATENT DOCUMENTS

| | | | |
|---|---|---|---|
| 604,723 | 5/1898 | Carver | 229/72 X |
| 1,025,837 | 5/1912 | Schnorr | 229/71 |
| 1,163,459 | 12/1915 | Rheutan | 229/72 X |
| 1,545,653 | 7/1925 | Hogan | 229/72 |
| 1,601,318 | 9/1926 | Overly | 229/71 |
| 1,964,595 | 6/1934 | Overly . | |
| 1,977,042 | 10/1934 | Cather . | |
| 2,171,702 | 9/1939 | Jones | 229/72 |
| 2,317,497 | 4/1943 | Thompson | 229/72 |
| 2,997,225 | 8/1961 | Whitman . | |
| 3,013,713 | 12/1961 | Whitman . | |
| 3,266,712 | 8/1966 | McCleneghan | 229/72 |
| 3,288,351 | 11/1966 | Benz, Jr. . | |
| 3,420,432 | 1/1969 | Cooper | 229/71 |

FOREIGN PATENT DOCUMENTS

| | | | |
|---|---|---|---|
| 534987 | 12/1956 | Canada | 229/71 |

*Primary Examiner*—Jes F. Pascua
*Attorney, Agent, or Firm*—Litman, Kraai & Brown L.L.C.; John C. McMahon

[57] ABSTRACT

An envelope having a false bottom is constructed of a front panel, a rear panel and a pair of side panels adhered to the rear panels. Adhesive strips are utilized to adhere each of the side panels to the front panel at a location spaced from the bottom of the front panel. The adhesive strips form shoulders between the front and side panels that limit the interior depth of the envelope so as to create a false bottom therein.

7 Claims, 3 Drawing Sheets

LIMITED POCKET ENVELOPE

BACKGROUND OF THE INVENTION

The present invention is related to envelopes for mailing documents and, especially, to envelopes having windows wherein the documents indicate address information that is seen through the windows and wherein the documents are not the same size as the envelope. In such envelopes there is a need to position the documents such that the address may be easily read through the envelope window and such that the document does not shift within the envelope to prevent reading of the address through the window.

Envelope manufacture has become a very specialized field in that envelopes are designed for hundreds of different purposes and each design requires different characteristics and has different limitations. In order to save time and printing costs, windowed envelopes are often utilized. The windowed envelope allows a portion of the contents of the envelope to be seen through an envelope window. In this manner the documents in the envelope can include the receiver's address, if it is properly positioned in the window, and allow the mail service to then deliver the envelope to the addressee.

For various reasons, the size requirements for the envelopes do not always match the size and shape of the contents. For example, some postal regulations may require a special sized envelope in order to obtain a particular mailing rate, whereas the contents to be mailed in the envelope may be smaller than the overall size of the envelope.

When, if the size of the contents is smaller than a windowed envelope and the contents contain the address information, then it is possible for the contents to shift within the envelope so as to prevent the mail service from being able to read the address information. Therefore, while it is desirable for the envelope to be of a particular size and shape, it is also desirable for the interior pocket of the envelope to be limited in shape and size so as to maintain the contents in a specific position to ensure the clear viewing of the address information located on the contents through the envelope window.

One method of limiting the size of the envelope pocket is to simply adhere the facing services of the front and back panels of the envelope together in an attempt to produce a false bottom. That is, a bead of adhesive in a strip may be placed in the middle of and near the lower end of the envelope in parallel, but spaced, relationship to the bottom edge of the envelope to try to adhere both the front and back panel together. A bead or strip of adhesive utilized in this fashion is illustrated in Benz U.S. Pat. No. 3,288,351.

Unfortunately, adhesive utilized in the manner described above is not always affective in joining the front and back panel. In particular, when envelopes of this type are constructed, side panels are rotated inwardly and joined to the front and back panels at the same time the back panel rotated to be adjacent to the front panel so as to form a pocket therebetween.

The side panels are typically fairly short and normally do not extend across the entire width of the envelope. Consequently, near the lateral edges of the envelope, the envelope is at least three layers thick (front panel, rear panel and one side panel), whereas typically in the middle of envelopes, the envelope is only two layers thick (the front panel and the rear panel).

During the manufacturing process adhesive is applied and then the envelopes are folded in an envelope folding machine, placed in cartons and held together while the adhesive dries. Because there are only two layers in the middle of the envelope as compared to three layers on the lateral sides of the envelope, there is not a significant amount of pressure placed against the layers in the middle where the two layers occur and the layers may even be spaced apart at this location. Because of this, there is little or no pressure applied to the adhesive during drying and the adhesive often fails to hold the layers together when applied in the region of the two layers. Thus, the creation of a false bottom fails in such cases.

Therefore, it is desirable to have an envelope in accordance with the present invention wherein the adhesive is utilized to form a highly reproducible limited pocket with a false bottom and wherein the adhesive is applied in the region whereat the envelope is three layers thick as opposed to the region where the envelope is two layers thick.

SUMMARY OF THE INVENTION

In accordance with the present invention an envelope is provided that includes a front panel, a rear panel and side panels joined so as to form a pocket therebetween. The pocket of the envelope is limited in depth by forming a false bottom. The false bottom is produced by adhering together elements of the envelope such that documents inserted into the envelope cannot pass entirely to the bottom of the envelope.

In order to ensure that the panels are adhered together to form a limited pocket, adhesive is placed near the lateral edges of the envelope in spaced relation from the bottom and whereat there are three panel layers including the front panel, rear panel and one of the side panels, as opposed to the middle of the envelope where there are two layers (the front panel and the rear panel). In this manner additional pressure is placed upon the adhesive when the envelope is stacked with others in cartons due to the additional thickness of the envelope where the adhesive is applied and the increased thickness substantially increases the likelihood that the adhesive will adhere opposite facing surfaces together during both manufacture, as the envelope passes through an envelope folding machine, and subsequently, as the adhesive dries after placement of the envelopes in cartons.

Also in accordance with the invention a method is provided for forming a limited pocket in an envelope by placing adhesive so as to join facing surfaces of the interior pocket of the envelope together at a location whereat there are three panel layers, including the front panel, rear panel and one side panel.

OBJECTS AND ADVANTAGES OF THE INVENTION

Therefore, the objects of the present invention are: to provide an envelope having an interior pocket wherein the depth of the interior pocket is limited with respect to the overall height of the envelope by a false bottom; to provide such an envelope wherein the depth of the pocket is limited by adhering together facing surfaces of the pocket at a desired pocket depth in a region where wall thickness is greatest; to provide such an envelope wherein adhesive is applied at a location whereat the front panel, rear panel and one side panel join in side by side relationship such that there is greater chance for the adhesive to bind together the facing surfaces forming the pocket as the adhesive dries; to provide such an envelope including a window and wherein the envelope receives contents having indicia thereon to be viewed through the window and further wherein the contents are substantially smaller in height dimension as compared to the envelope such that it is desirable to maintain the contents in a particular location within the envelope to ensure that the indicia may be viewed through the window; to provide a method of constructing an envelope wherein adhesive is placed between two facing surfaces of an interior pocket of the envelope at a location whereat a maximum number of layers are located so as to increase a likelihood that an adhesive will join the surfaces together and form a limited pocket with a false bottom within the envelope; and to provide such an envelope which is relative easy to construct, simple to use and especially well suited for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
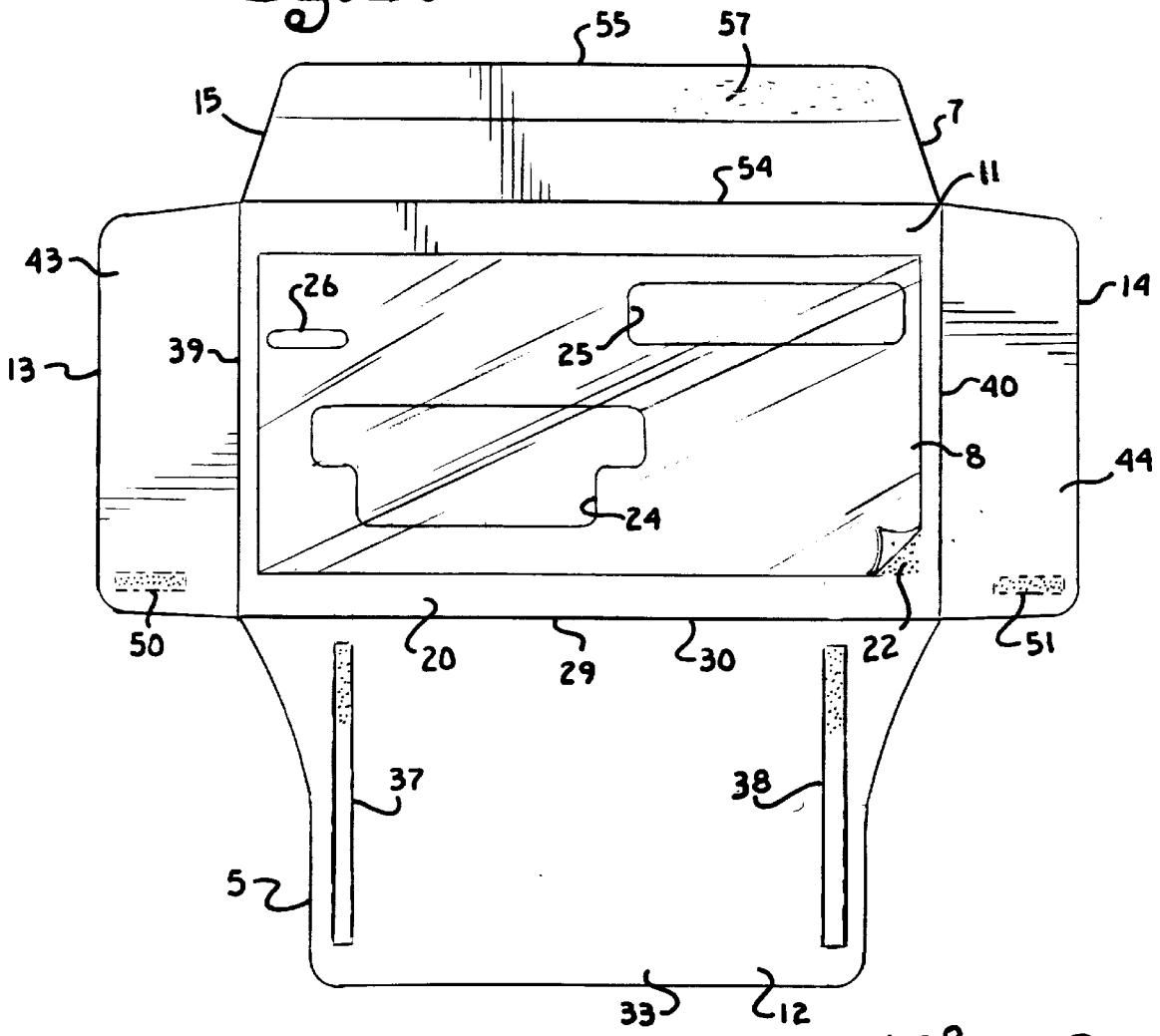
FIG. 1 is a front elevational view of an envelope blank for use in constructing an envelope in accordance with the present invention.

The reference numeral 1 generally designates an envelope in accordance with the present invention. The envelope 1 is constructed by the folding and adhering together panels of an envelope blank 5 which is illustrated in FIG. 1. The envelope blank 5 is generally cut from a single sheet 7 of paper stock to which is attached a clear rectangular sheet 8 of plastic material.

The envelope blank 5 includes a front panel 11, a rear panel 12, a pair of laterally positioned side panels 13 and 14 and a sealing flap 15.

The front panel 11 has an inside surface 20 and an outside surface 21. The clear sheet of plastic 8 is adhered to the front panel inside surface 20 by adhesive 22. The front panel 11 also includes three windows 24, 25 and 26 therethrough. The windows 24, 25 and 26 are positioned so as to be covered on the inside by the clear sheet of plastic 8. The window 24 is located whereat the address information is normally positioned on a letter and the window 25 is located whereat the return information is normally placed on a letter.

The front panel 11 is connected at a lower or bottom edge 29 of the envelope by a fold line 30 to the rear panel 12. The bottom of the front panel 11 and rear panel 12 are thus continuously connected across the bottom edge 29 and joined at the fold line 30. In the illustrated embodiment, the rear panel 12 has a somewhat different shape as compared to the front panel 11; however, in accordance with the invention, it is foreseen that the two panels may have identical shapes or a plurality of different shapes.

Figure 5:
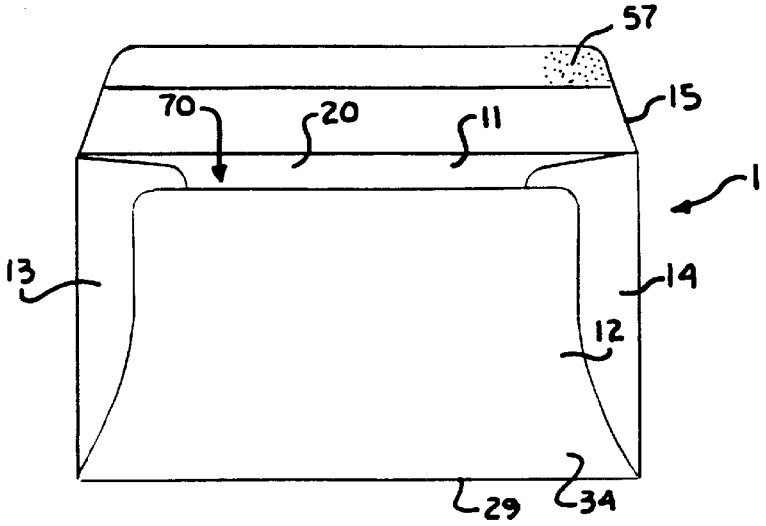
FIG. 5 is a rear elevational view on a reduced scale of the fully constructed envelope.

The rear panel 12 has an interior surface 33 which partially abuts against and faces the front panel interior or inside surface 20 when the envelope is constructed, as in FIG. 5. Located on the rear panel interior surface 33 are two strips of adhesive 37 and 38 which run generally from near the bottom to near the top of the rear panel 12 and which are laterally positioned thereon.

The side panels 13 and 14 are joined along fold lines 39 and 40 respectively, see FIG. 1, to the front panel 11 so as to be continuous therewith along the fold lines 39 and 40. The side panels 13 and 14 have approximately the same height (top to bottom) as the front panel 11, but are substantially narrower in width (side to side in FIG. 1)

Each of the side panels 13 and 14 have front panel facing surfaces 43 and 44 respectively and rear panel facing surfaces 45 and 46 respectively. Located near the bottom of each of the front panel facing surfaces 43 and 44 of the side panels 13 and 14 are laterally extending strips of adhesive 50 and 51 respectively. The adhesive strips 50 and 51 extend side to side across a substantial portion of each of the side panels 13 and 14 and are spaced in accordance with the positioning necessary to produce a limited pocket 53 as described further below. Each of the strips of adhesive 50 and 51 join the rear panel 12 to the side panels 13 and 14 respectively so as to form upper shoulders 52 within the finished envelope (see, for example, FIG. 8). The shoulders 52 in turn form a false bottom which limits the depth to which documents can be inserted within the envelope 1. The interior of the envelope 1 above the shoulders 52 forms the pocket 53 which holds documents.

The seal flap 15 is joined along a fold line 54 to an upper end of the front panel 11 so as to be continuous therewith. Located along and parallel to an upper edge 55 is a moisture activated adhesive sealing strip 57.

Figure 2:
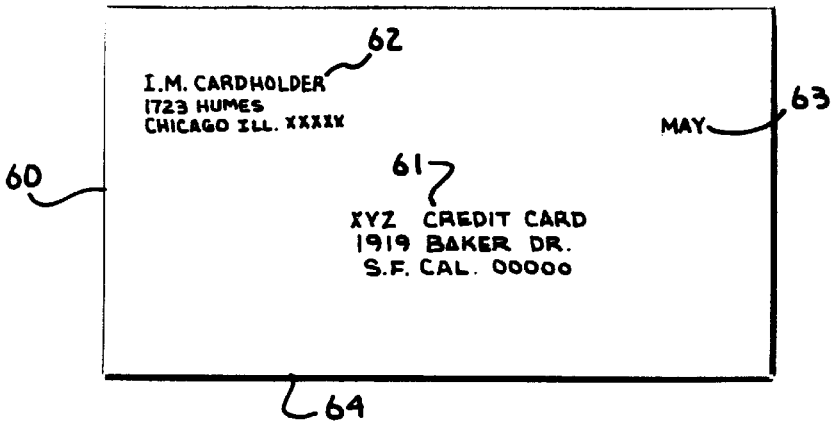
FIG. 2 is a front elevational view of an envelope insert.

Shown in FIG. 2 is a folded rectangular document or insert 60 for use in conjunction with the envelope 1. The insert 60 includes thereon a first indicia 61 providing a address, a second indicia 62 providing a return address and third indicia 63 providing other processing information. The indicia 61, 62 and 63 are so aligned as to present and be visible through the windows 24, 25 and 26, if the insert 60 is properly positioned within the envelope 1. The insert 60 has approximately the same or a slightly smaller width (but wider than the spacing of the shoulders 52) as compared to the envelope 1, but has a shorter height as compared to the envelope 1. In the illustrated embodiment (seen in FIG. 1 at one half actual size) the differential in height is approximately one half inch; however, this is expected to vary depending upon the particular use of the insert 60 and the particular size of the envelope 1 used for each embodiment. The insert 60 has a bottom edge 64 that rests on the shoulders 52 when the insert 60 is placed in the envelope pocket 53 (see FIG. 8), so as to ensure that the address indicia 61 remains clearly visible through the window 24 during transit.

Although the side panels 13 and 14 of the present invention are illustrated as being attached to the front panel 11, it is foreseen that the side panels could alternatively be attached to the rear panel with certain modifications. In particular, the rear panel would have to have a shape which would be similar to the shape of the illustrated front panel and the adhesive which is shown as strips 37 and 38 that join the rear panel 12 of the illustrated embodiment to the side panels 13 and 14 would have to be placed on the front panel which would in turn limit the location of the windows and plastic sheet on the front panel. It is also foreseen that the envelope 1 may be varied in width and/or the flaps 13 and 14 may be varied in width (so as to hold wider strips of adhesive 50 and 51) in order to accommodate inserts 60 of different widths. However, it is necessary to not space the shoulders 53 as wide as the insert 60 in order to prevent the insert 60 from falling between the shoulders 53.

Figure 3:
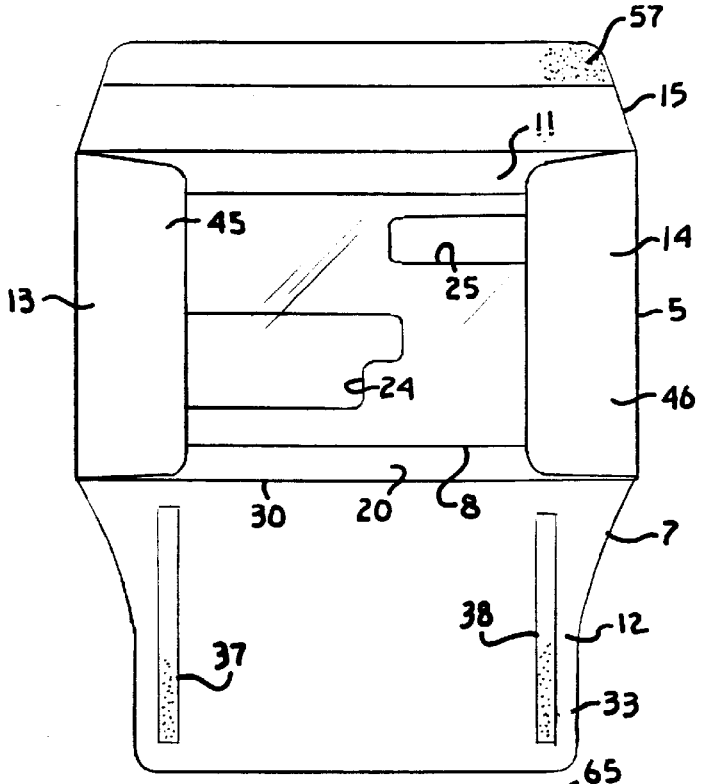
FIG. 3 is a front elevational view of the envelope blank on a reduced scale with side panels folded inwardly during construction of an envelope.

As is seen in FIG. 3, the completed envelope 1 is constructed by first folding the envelope blank 5 in a manner such that the side panels 13 and 14 are folded along the fold lines 39 and 40 so as to abut against the front panel 11. The rear panel 12 is then folded along fold line 30 so as to abut against the side panels 13 and 14 and face the front panel 11, as is shown in FIG. 5. The adhesive strips 37 and 38 adhere the rear panel in this manner to the side panels 13 and 14 respectively.

Figure 4:
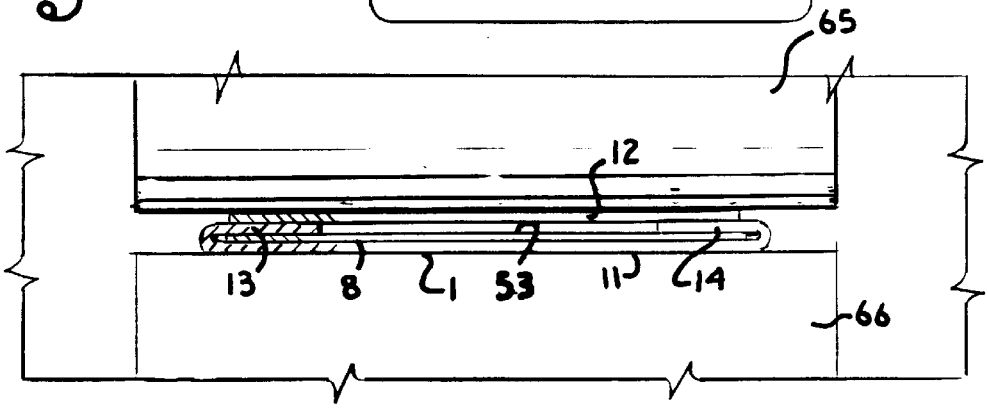
FIG. 4 is a cross sectional view of the envelope blank of FIG. 3 during a further processing step wherein a rear panel is folded over a front panel of the blank and passed through rollers of an envelope manufacturing machine to produce the envelope.

When the side panels 13 and 14 are folded as is shown in the step seen in FIG. 3, the adhesive strips 50 and 51 engage and adhere to the front panel 11 at a location spaced from the bottom 29 of the envelope 1 to form the shoulders 52. This folding process is seen in FIG. 4 in crossection where the envelope 1 is passing through rollers 65 and 66 in a conventional envelope folding machine (the remainder of which is not shown).

The folding of the various panels and assembly, as is shown in a completed form in FIG. 5, produces therein the pocket 53. The pocket 53 is formed between the front panel 11 and the front panel facing surfaces 43 and 44 of the side panels 13 and 14 respectively as well as the portion of the rear panel interior surface 33 which is not covered by the side panels 13 and 14. However, the pocket 53 is limited in depth by the position of the adhesive strips 50 and 51. In particular, the adhesive strips 50 and 51 join together the side panels 13 and 14 respectively with the front panel 11 at the location whereat the adhesive strips 50 and 51 are located. This forms a barrier or false bottom near the lateral or outer side of the envelope 1 which prevents a document such as the insert 60 having a width similar to the envelope 1 from being inserted into the envelope 1 past the shoulders 52 formed by the adhesive strips 50 and 51. Therefore, the pocket 53 is formed in shape so as to snugly receive the insert 60 such that the insert 60 will not slip thereabout.

Figure 6:
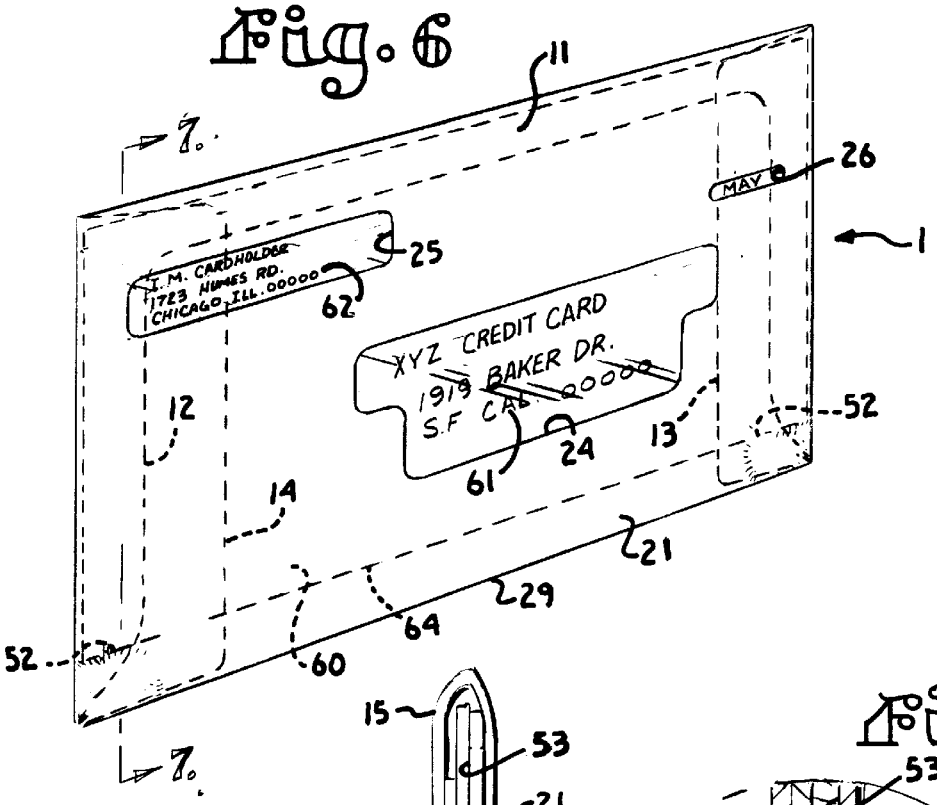
FIG. 6 is a front perspective view of the fully constructed and sealed envelope with the insert contained therein and with certain interior structure of the envelope illustrated with phantom lines.
Figure 7:
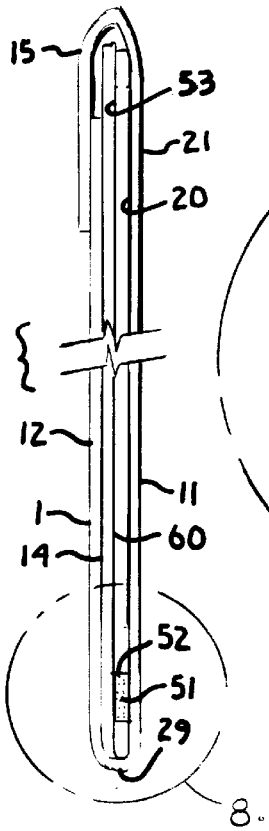
FIG. 7 is an enlarged cross sectional view of the completed envelope with insert, as shown in FIG. 6, taken along line 7—7 of FIG. 6.
Figure 8:
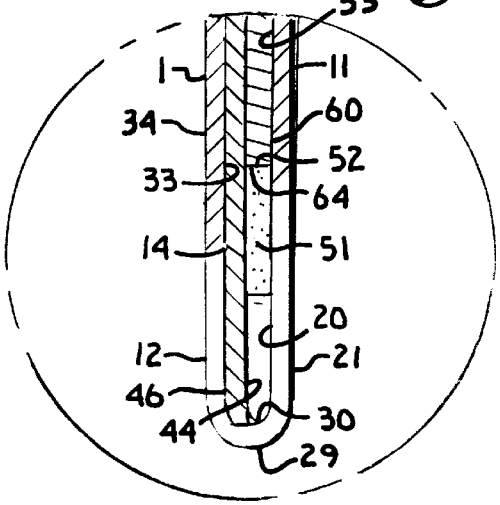
FIG. 8 is a further substantially enlarged cross sectional view of the completed envelope of FIG. 6 illustrating the region, identified by the circle labeled No. 8 in FIG. 7, in greater detail.

Illustrated in FIGS. 6, 7 and 8 are the envelope 1 with the insert 60 therein. As is seen in FIG. 8, the adhesive strip 51 limits the depth to which the insert 60 can enter the pocket 53. In this manner the indicia 61, 62 and 63 are seen clearly in the windows 24, 25 and 26 respectively.

It is to be understood that while certain forms of the present invention have been illustrated and described herein, it is not to be limited to the specific forms or arrangement of parts described and shown.

What is claimed and desired to be secured by Letters Patent is as follows:

1. An envelope having an interior pocket with a false bottom with a depth that is less than an outer height of the envelope; said envelope comprising:

a) a front panel and a rear panel;

b) first and second side panels; each of said side panels being joined to said front panel along respective fold lines;

c) each of said side panels being folded to overlap said front panel and being joined by adhesive to said rear panel generally along the height of each of said side panels so as to form said envelope pocket between said front panel, said rear panel and said side panels;

d) said envelope has a bottom edge; and wherein:

e) adhesive strips adhere said front panel to each of said side panels such that shoulders are formed by said adhesive strips between said front panel and both of said side panels to support contents placed in said envelope in spaced relation to a bottom of said envelope to form said pocket at a location substantially spaced from said envelope bottom and at a location whereat a respective side panel, said front panel and said rear panel all overlap, such that no substantial portion of the envelope overlaps more panels than the number of panels associated with and overlapping said adhesive strips and so as to limit the depth of said pocket relative to the overall height of said envelope.

2. An envelope according to claim 1 including:

a) an insert having a height less than said envelope and being received in said envelope and supported therein in spaced relation to said envelope bottom at the false bottom by said shoulders.

3. An envelope having a height and adapted to receive an insert of less height while maintaining the insert in a selected portion of the envelope with a false bottom; the envelope comprising:

a) a front panel having a lower edge and at least one window located therein;

b) a rear panel having a lower edge joined to said front panel lower edge and at least partially overlaying said front panel;

c) first and second side panels joined along fold lines to said front panel; said first and second side panels being folded to overlap said front panel and to be at least partially positioned between said front and rear panels; said side panels being at least partially adhered to said rear panel such that said front, rear and side panels form a pocket therebetween; and d) adhesive strips located whereat said front and rear panels both overlap said first and second side panels respectfully and both of said adhesive strips being spaced from said front panel lower edge so as to form a pair of spaced shoulders of lesser depth than the overall depth of the envelope between said front panel and said first and second side panels defining said pocket; said envelope having at least as many panels overlapping said adhesive strip as overlapping in any other region of said envelope.

4. An envelope according to claim 3 wherein:

a) said adhesive strips extend substantially across respective side panels parallel to and spaced from said front panel lower edge.

5. An envelope according to claim 3 and including:

a) the insert wherein the insert has a height substantially less than the height of said envelope and said insert has a bottom edge received on and supported by said shoulder.

6. A method of forming a false bottom in an envelope having an interior pocket of lesser depth than the overall depth of the envelope formed by joining together a front panel, a rear panel and a pair of side panels; the method comprising the step of:

a) adhering together said front panel with a first of said side panels at a location spaced from a lower edge of said front panel and whereat at least said front panel, said rear panel and said first side panel overlap so as to form a first insert receiving and depth limiting shoulder within said pocket, while overlapping said shoulder with at least as many of said panels as overlap elsewhere in said envelope; and b) adhering said second side panel to said front panel so as to form a second insert receiving shoulder laterally spaced from said first shoulder and located whereat said front panel, said rear panel and said second side panel overlap.

7. The method according to claim 6 including:

a) adhering said first and second side panels to said rear panel along a substantial portion of the height thereof.

* * * * *